US008056167B2

(12) United States Patent
Cheung et al.

(10) Patent No.: US 8,056,167 B2
(45) Date of Patent: Nov. 15, 2011

(54) PILLOW SPEAKER SYSTEM AND METHOD

(75) Inventors: Kwun-Wing W. Cheung, Shoreline, WA (US); Kevin S. Zielke, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1456 days.

(21) Appl. No.: 11/533,749

(22) Filed: Sep. 20, 2006

(65) Prior Publication Data

US 2008/0069387 A1 Mar. 20, 2008

(51) Int. Cl.
*A47C 20/00* (2006.01)

(52) U.S. Cl. ..... 5/639; 5/644; 5/645; 5/904; 381/301; 381/333

(58) Field of Classification Search ..... 5/630, 632, 5/636, 639, 644, 417, 420, 706, 707, 709, 5/710, 652, 654, 655, 655.3, 904, 645; 381/301, 381/333

See application file for complete search history.

(56) References Cited

U.S. PATENT DOCUMENTS 1,515,467 A * 11/1924 Draving ..... 381/388
1,931,312 A * 10/1933 Arnson ..... 381/388
3,085,568 A * 4/1963 Whitesell ..... 601/55
3,342,285 A * 9/1967 Robbins ..... 181/153
6,044,161 A 3/2000 Lee
6,131,219 A * 10/2000 Roberts ..... 5/644
6,493,888 B1 * 12/2002 Salvatini et al. ..... 5/423
7,127,075 B2 * 10/2006 Park ..... 381/151

OTHER PUBLICATIONS http://www.unwind.com/Merchant.myc?Screen=PROD&Product_Code=SSC&Category_Code=PSS Serenity Speaker Pillow/Cushion.

http://www.pillow-phonic.com/ "Pillow-Phonic Stereo Pillow Speakers".

http://www.edgereview.com/reviews.cfm?Category=audio&ID=32 "Reviewed: SoftSpeaker Pillow Speaker".

* cited by examiner

*Primary Examiner* — Robert G Santos
*Assistant Examiner* — Nicholas Polito
(74) *Attorney, Agent, or Firm* — Klintworth & Rozenblat IP LLC

(57) ABSTRACT

The invention discloses differing embodiments of pillow speaker systems and methods. In one embodiment, a method is disclosed of directing sound energy emitted from a speaker substantially into a cavity of a gas pillow. In other embodiments, pillow speaker systems are disclosed which direct sound energy emitted from the speakers substantially into the gas pillow cavity.

20 Claims, 13 Drawing Sheets

PILLOW SPEAKER SYSTEM AND METHOD

BACKGROUND OF THE INVENTION

There are existing pillow speaker systems and methods. Many of these pillow speaker systems and methods do not substantially direct sound emitted from the speakers directly into the cavity of the gas pillow. As a result, sound emitted from the speakers may travel outside of the gas pillow cavity which may lead to sound several feet away from the pillow. This sound may disrupt people who are not the intended listeners. In other existing pillow speaker systems and methods, other types of problems may be present.

A pillow speaker system and method is needed which may solve one or more problems in one or more of the existing pillow speaker systems and methods.

SUMMARY OF THE INVENTION

In one aspect of the invention, a pillow speaker system includes an inflatable pillow and at least one speaker. The inflatable pillow includes a gas cavity closed off to air outside of the gas cavity. The at least one speaker is substantially enclosed within the gas cavity so that sound emitted from the speaker is substantially contained within the gas cavity.

In another aspect, the invention discloses a pillow speaker system including an inflatable pillow and at least one speaker. The gas cavity is closed off to air outside of the gas cavity. The at least one speaker includes a diaphragm for emitting sound substantially into the gas cavity. The diaphragm is substantially located between a support member and a first surface of the gas cavity. One surface of the diaphragm is substantially covered by the first surface of the gas cavity, and a second surface of the diaphragm is substantially covered by the support member.

In a further aspect of the invention, a method is disclosed of directing sound energy emitted from a speaker substantially into a cavity of a gas pillow. In one step, a speaker is provided. In another step, a gas pillow is provided which includes a cavity closed off to air outside of the gas cavity. In still another step, the speaker is attached to the gas pillow. In yet another step, sound emitted from the speaker is directed substantially into the gas cavity.

These and other features, aspects and advantages of the invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
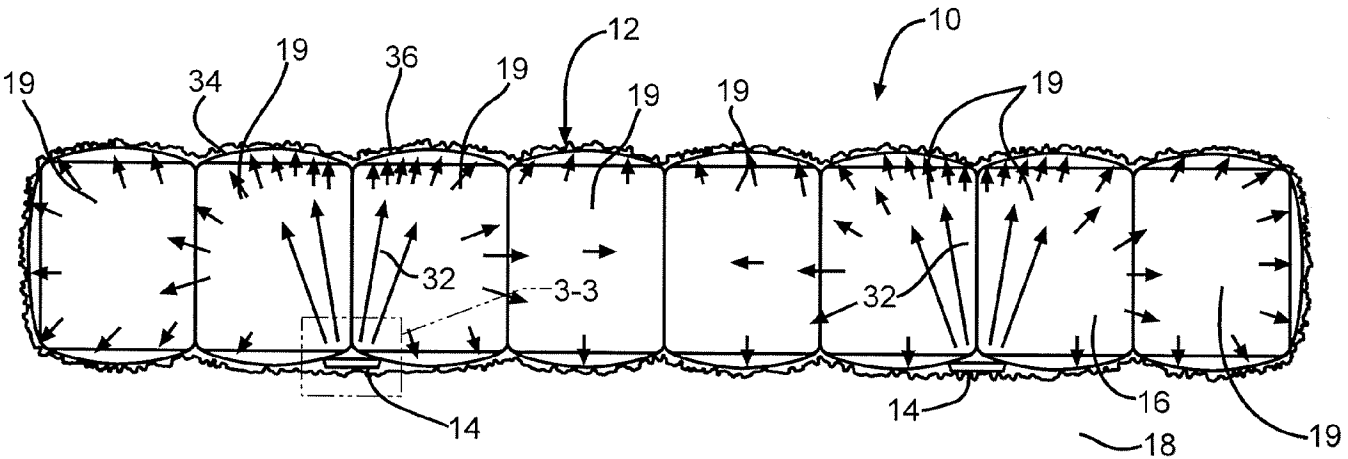
FIG. 1 depicts a side view of a pillow speaker system under one embodiment of the invention.
Figure 2:
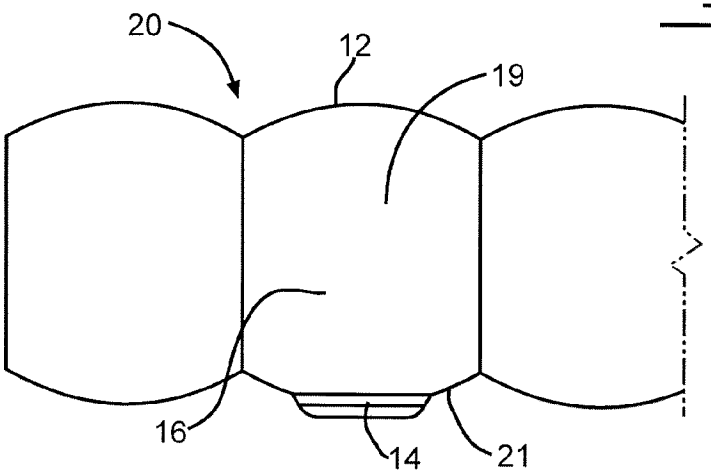
FIG. 2 depicts a partial side view of a second embodiment of a pillow speaker system under the invention.

As shown in FIG. 1, in one embodiment of the invention a pillow speaker system 10 may include an inflatable pillow 12, and two speakers 14 oriented at left and right sides of the pillow 12. The pillow 12 may be made of plastic or other materials. In other embodiments, any number, type, size, and location of speakers 14 may be utilized. The inflatable pillow 12 may include a gas cavity 16 which is closed off to air 18 outside of the gas cavity 16. The gas cavity 16 may include a plurality of interconnected cells 19 adapted to distribute gas throughout the cavity 16. Each of the speakers 14 may be located between two cells 19 of the gas cavity 16. FIG. 2 shows another embodiment 20 of the invention in which the speaker 14 is attached to a bottom surface 21 of one cell 19, rather than being located between two cells.

The gas cavity 16 of FIG. 1 may be adapted to hold air or other mixtures of gas. When inflated, the air within the gas cavity 16 may have an internal pressure of substantially in the range of 0.25 pounds per square inch to 1.5 pounds per square inch. The pressure within the pillow 12 may be lower when the pillow 12 is not in use then when a person lays his head on the pillow 12. In other embodiments, the pressure within the gas cavity 16 may be varied.

Figure 3:
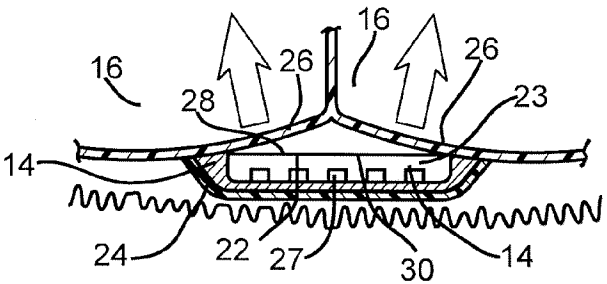
FIG. 3 depicts a partial sectional view within rectangle 3-3 in the embodiment shown in FIG. 1.
Figure 4:
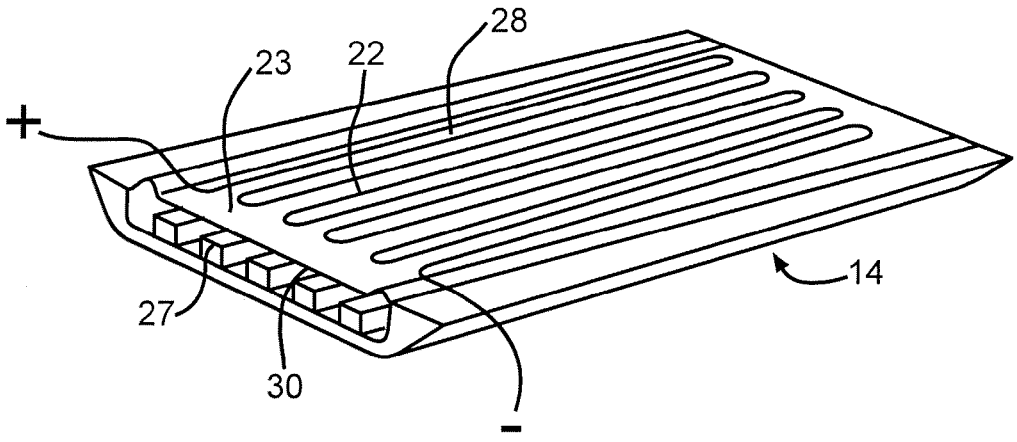
FIG. 4 depicts a perspective view of one of the speakers shown in the embodiment of FIG. 1.

As shown in FIGS. 1, 3 and 4, each of the speakers 14 may include a diaphragm 23 with an embedded coil 22 for emitting sound substantially into the gas cavity 16, and a magnet 27. The diaphragm 23 may be made of a light, hard, durable and/or flexible material such as Mylar, Polypropylene, Kapton, or other materials. The coil 22 may be made of ductile wires, or copper printed circuit. The coil 22 may act by the electro magnetic induction rule, reacting with the magnetic field emitted by the magnet 27 in order to move the diaphragm 23 back and forth in order to vibrate air to generate sound. The speakers 14 may have a substantially flat shape as shown, or in other embodiments may have varied shapes such as a low-profile cone shape.

Each of the speakers 14, including their diaphragms 23, may be substantially located, and/or completely located, between a support member 24 and a bottom surface 26 of the gas cavity 16. A top surface 28 of the diaphragm 23 and/or a top surface of the speaker 14 may be substantially covered, and/or completely covered, by the bottom surface 26 of the gas cavity 16. In other embodiments, a rigid grill member may also substantially and/or completely cover a top surface of the speaker 14 in order to prevent diaphragm 23 from contacting bottom surface 26. A bottom surface 30 of the diaphragm 23 and/or a bottom surface of the speaker 14 may be substantially covered, and/or completely covered, by the support member 24, and may be spaced apart from the magnet 27. The diaphragms 23 may be aimed upward towards an interior 32 of the gas cavity 16 in order to direct sound emitted from the diaphragms 23 substantially into the gas cavity 16. By locating the diaphragm 23 close to the bottom surface 26 of the gas cavity 16 and enclosing it with the support member 24, sound emitted from the diaphragm 23 may be substantially prevented from traveling outside of the gas cavity 16.

The support member 24 may comprise a pocket member which is attached to the bottom surface 26 of the gas cavity 16 in order to hold the speaker 14 in between the bottom surface 26 of the gas cavity 16 and the support member 24. One side of the pocket member may be open in order to allow the speakers 14 to be inserted into and taken out of the pocket member during replacement. In another embodiment, the support member 24 may comprise a bottom surface of the speaker 14 which is attached to the bottom surface 26 of the gas cavity 16 in order to hold the speaker 14 in between the bottom surface 26 of the gas cavity 16 and the support member 24. In other embodiments, the support member 24 may be of other types. The support member 24 may be glued or taped to the bottom surface 26 of the gas cavity 16 or attached in different manners.

Figure 5:
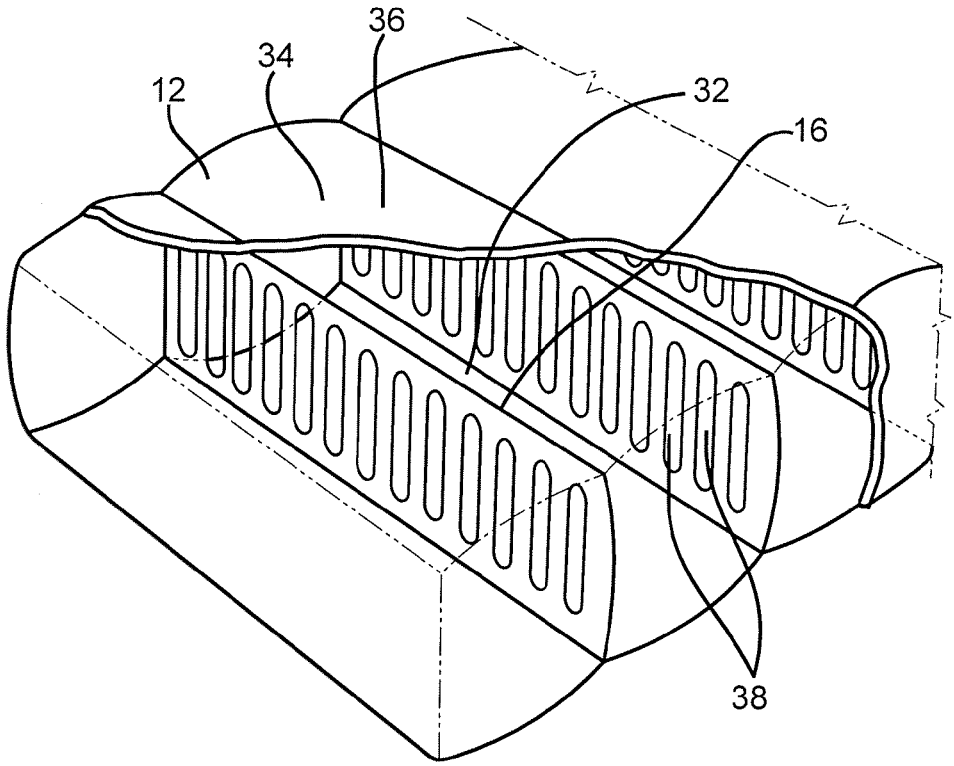
FIG. 5 depicts a perspective view of one embodiment of a pillow under the invention having a plurality of slotted partitions.

Sound emitted from the speakers 14 may substantially travel through the bottom surface 26 of the gas cavity 16, and into the interior 32 of the gas cavity 16. The sound may be omni-directional and may be distributed throughout the interior 32 of the gas cavity 16. As shown in FIG. 5, the interior 32 of the gas cavity 16 may have one or more slotted partitions 38 to allow sound disperse within the gas cavity 16. One or more surfaces 34 of the gas cavity 16, such as a top surface 36 of the gas cavity 16, may substantially absorb the sound and block it from radiating outward to hold the sound substantially within the gas cavity 16. In such manner, the sound may be substantially audible to a person laying his head on the pillow 12, while the sound may be substantially inaudible at a distance of substantially five feet away from the pillow 12. In other embodiments, the sound may be substantially inaudible a few feet from the pillow 12, or at other distances from the pillow 12.

Figure 6:
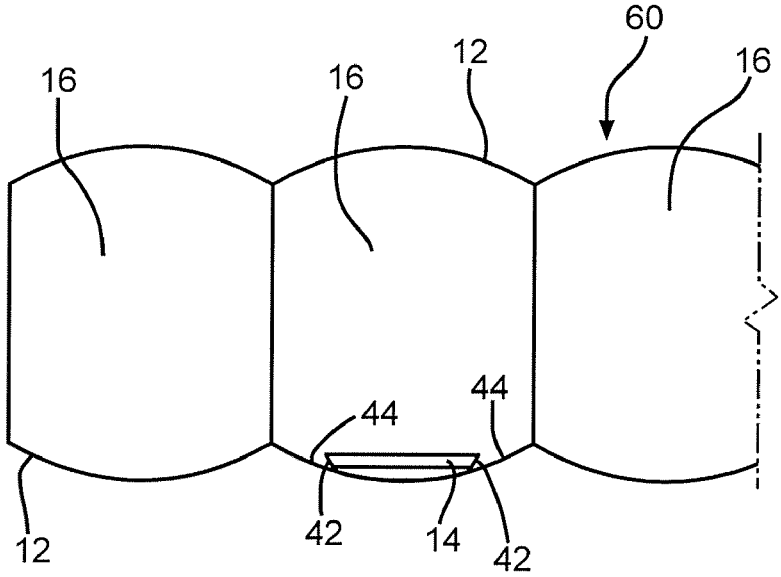
FIG. 6 depicts a partial side view of another embodiment of a pillow speaker system under the invention.

FIG. 6 shows another embodiment of the invention in which the pillow speaker system 60 may contain one or more speakers 14 enclosed within the gas cavity 16 of the inflatable pillow 12. In such manner, sound emitted from the speakers 14 may be substantially contained within the gas cavity 16. One or more side surfaces 42 of the one or more speakers 14 may be attached to an interior surface 44 of the gas cavity 16 by being glued or through other attachment methods. In other embodiments, a bottom surface, or other surfaces, of the speakers 14 may be attached to the interior surface 44 of the gas cavity 16. It should be noted that any of the particular elements for any of the embodiments disclosed herein may be applied in combination with any of the disclosed embodiments.

FIG. 6 shows another embodiment of the invention in which the pillow speaker system 60 may contain one or more speakers 14 enclosed within the gas cavity 16 of the inflatable pillow 12. In such manner, sound emitted from the speakers 14 may be substantially contained within the gas cavity 16. In other embodiments, the one or more speakers 14 may be substantially enclosed within the gas cavity 16 of the pillow 12 in order to substantially contain sound emitted from the speakers 14 within the gas cavity 16. For instance, in one embodiment, at least a portion of the pillow speaker system 60 may be located within an opening which passes through an exterior wall of the gas cavity 16. One or more side surfaces 42 of the one or more speakers 14 may be attached to an interior surface 44 of the gas cavity 16 by being glued or through other attachment methods. In other embodiments, a bottom surface, or other surfaces, of the speakers 14 may be attached to the interior surface 44 of the gas cavity 16. It should be noted that any of the particular elements for any of the embodiments disclosed herein may be applied in combination with any of the disclosed embodiments.

Figure 7:
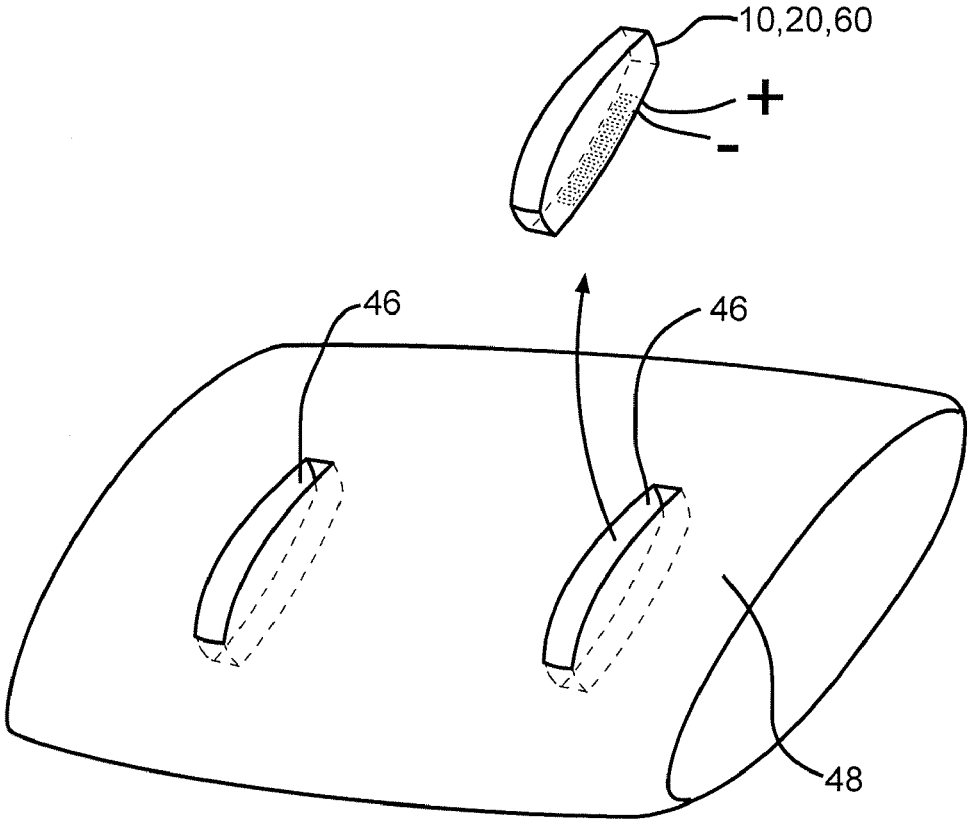
FIG. 7 depicts a perspective view of a pillow speaker system being inserted into an opening in another pillow under another embodiment of the invention.

As shown in FIG. 7, any of the pillow speaker system embodiments 10, 20, and 60 disclosed herein may be inserted/located within one or more openings 46 in a second pillow 48. The second pillow 48 may be made of foam, fabric, and/or other types of material. In such manner, the sound quality of the pillow speaker systems 10, 20, and 60 may be utilized in another pillow.

Figure 8:
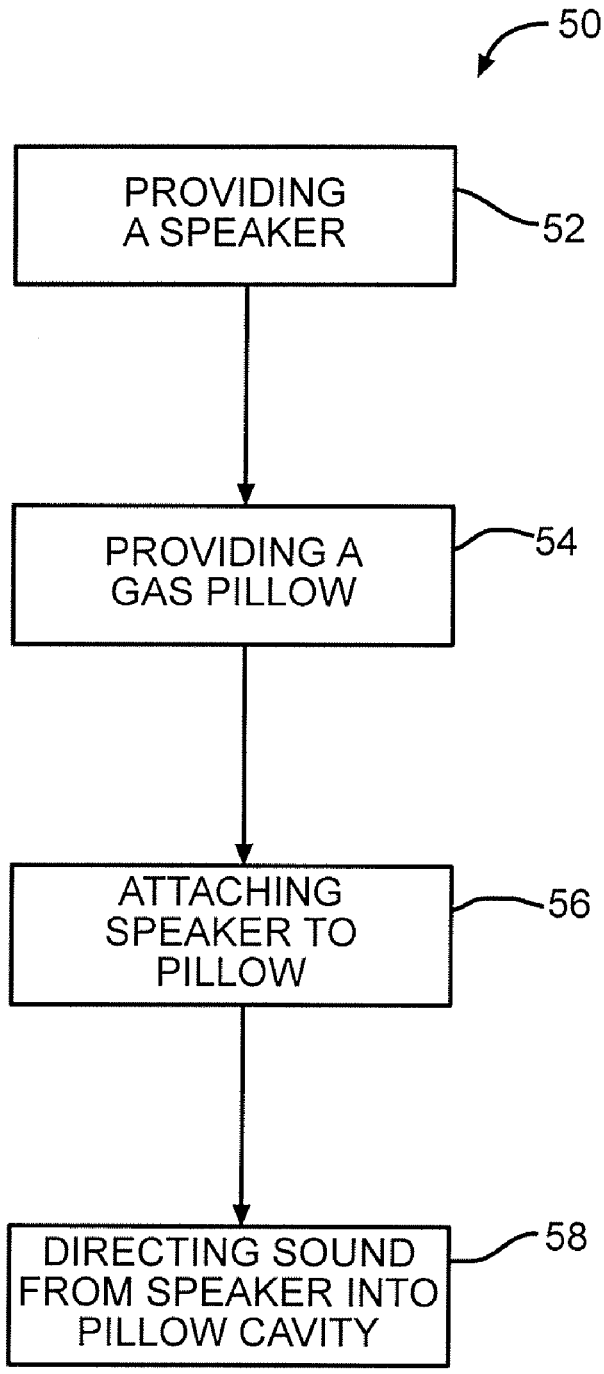
FIG. 8 shows a flowchart depicting one embodiment under the invention of a method for directing sound energy emitted from a speaker substantially into a cavity of a gas pillow.

FIG. 8 depicts a flowchart showing a method 50 of directing sound emitted from a speaker substantially into a cavity of a gas pillow. In one step 52, a speaker may be provided. The speaker may include a diaphragm, and may be in the shape of a flat surface, a cone surface, or in other shapes or configurations. In another step 54, a gas pillow may be provided. The gas pillow may include a cavity which is closed off to air outside of the gas cavity. In yet another step 56, the speaker may be attached to the gas pillow. This step may be accomplished by attaching the speaker to one or more of an interior and an exterior surface of the cavity. In still another step 58, sound emitted from the speaker may be directed substantially into the gas cavity of the pillow. One or more walls of the gas cavity may substantially absorb the sound within the cavity, and/or substantially prevent the sound from being substantially audible at a distance of substantially five feet away from the gas pillow. The method 50 may utilize any of the particular embodiments disclosed herein. Any of the embodiments of the pillow speaker systems disclosed herein may be utilized in an airplane, such as in an airplane sleeping compartment, in other parts of the airplane, or for domestic use.

Figure 9:
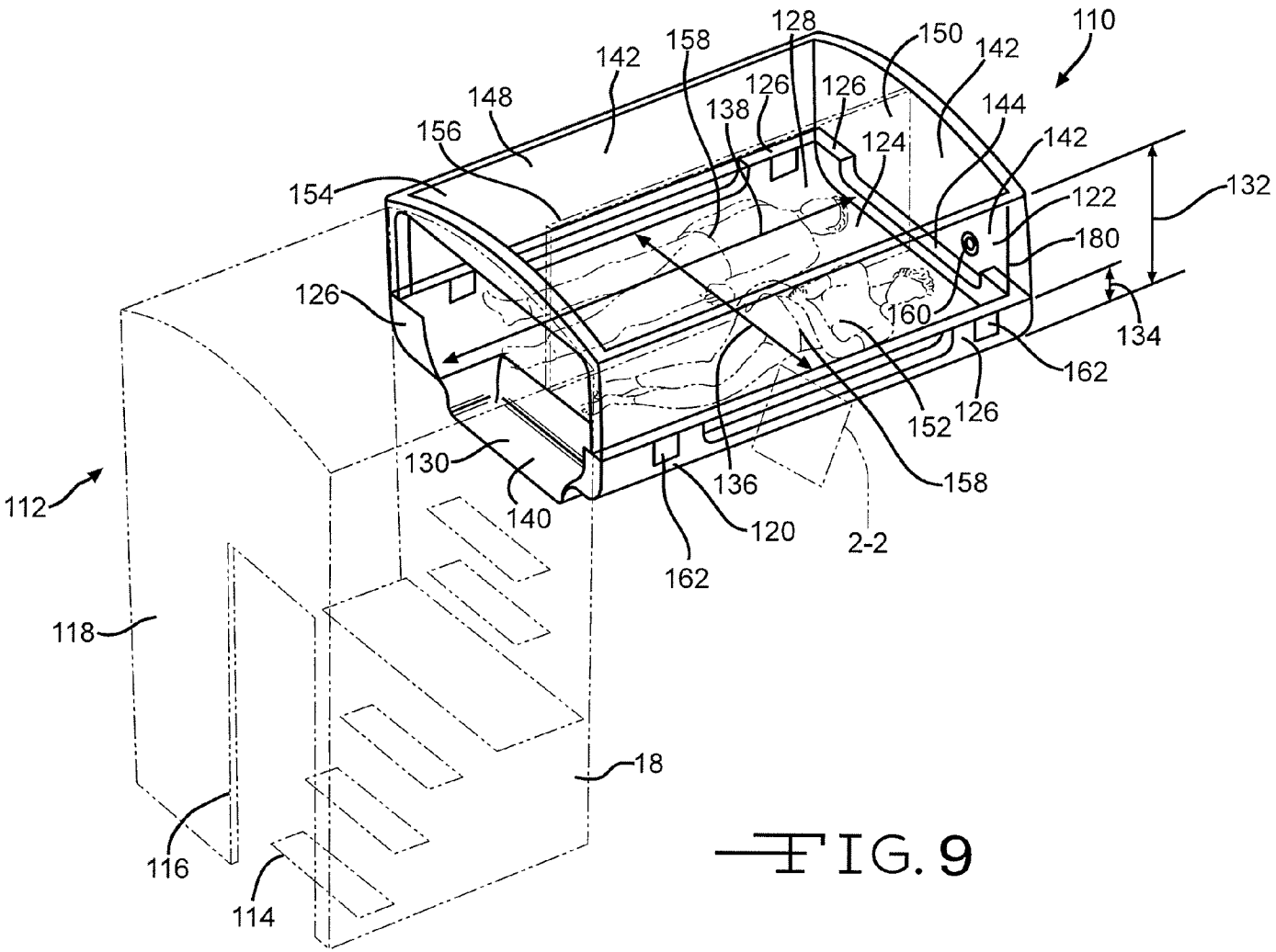
FIG. 9 shows a perspective view of a compartment and attached monument according to one embodiment of the invention which may be used in a transportation device.

FIG. 9 shows a perspective view of a compartment 110 and attached monument 112 according to one embodiment of the invention which may be used in a transportation device such as an aircraft, boat, train, automobile, vehicle, bus, or truck. The pillow speaker system 10 of FIG. 1 may be utilized in any portion of the compartment 110 of FIG. 9 in order to allow a person in the compartment 110 to listen to the speaker system 10 without disturbing others. The monument 112 may comprise a stairway 114 including a doorway 116 and walls 118. The stairway 114 may provide one or more persons with access to the compartment 110. The doorway 116 may enable one or more persons to close off the monument 112 for privacy. The walls 118 may enclose the monument 112 and provide structural support for the stairway 114. The compartment 110 may be installed in an overhead position within the transportation device. In other embodiments, the compartment 110 may be installed in varying locations, orientations, and configurations within the transportation device. In additional embodiments, the attached monument 112 may comprise varying structures such as a stowage area, a galley area, or other types of structures, while the compartment 110 may comprise varying structures such as a rest area, storage area, overhead area, and/or a privacy area.

The compartment 110 may include a one-piece basin 120 and an attached retractable and extendable enclosure member 122, which is shown in FIG. 9 in an inflated, extended state. The size of the basin 120 may be chosen to allow the basin to fit through an opening in the transportation device, such as through a door. The basin 120 may serve as the primary load bearing member of the compartment 110. In other embodiments, the one-piece basin 120 may be adapted to be attached to a retractable and extendable enclosure member 122. Any portion of the enclosure member 122 may contain the pillow speaker system 10 of FIG. 1 in order to allow a person in the compartment 110 to listen to the speaker system 10 without disturbing others.

The one-piece basin 120 may be made of a fiber-resin composite, may be injected molded, and/or may be made utilizing other materials or methods. Systems such as electrical systems or ECS (Environmental Control Systems) ducting systems may be integrated into the one-piece basin 120. The one-piece basin 120 may comprise a substantially flat base member 124 forming a floor surface of the compartment 110, side-walls 126 extending in non-parallel relationship to base member 124, a cavity 128 formed in between the base member 124 and side-walls 126, and a knee-hub 130. The side-walls 126 may substantially extend around a periphery of the base member 124. The one-piece basin 120 may obviate the need for brackets to support the side-walls 126, which may make the entire compartment 110 lighter.

The side-walls 126 may curve upward, or may extend straight upward from the base member 124. In one embodiment, the side-walls 126 may extend between six inches and two feet up from the base member 124. For example, in one embodiment, the side-walls 126 may extend one foot up from base member 124. The side-walls 126 may extend perpendicularly to base member 124. The side-walls 126 may not extend a full height 132 of the compartment 110, and may have a height dimension 134 which is less than both a width 136 and a length dimension 138 of the base member 124. In other embodiments, the side-walls 126, base member 124, and basin 120 may be in a variety of sizes, shapes, orientations, and configurations.

The knee-hub 130 may comprise a lowered stepped surface 140 for entering the attached monument 112 from the compartment 110. The lowered stepped surface 140 may comprise a flat portion parallel to base member 124 and between six inches and two feet below base member 124. The knee-hub 130 may be supported by walls extending from and integral to base member 124. In other embodiments, the one-piece basin 120 may be in differing shapes, sizes, orientations, and/or configurations.

Figure 10:
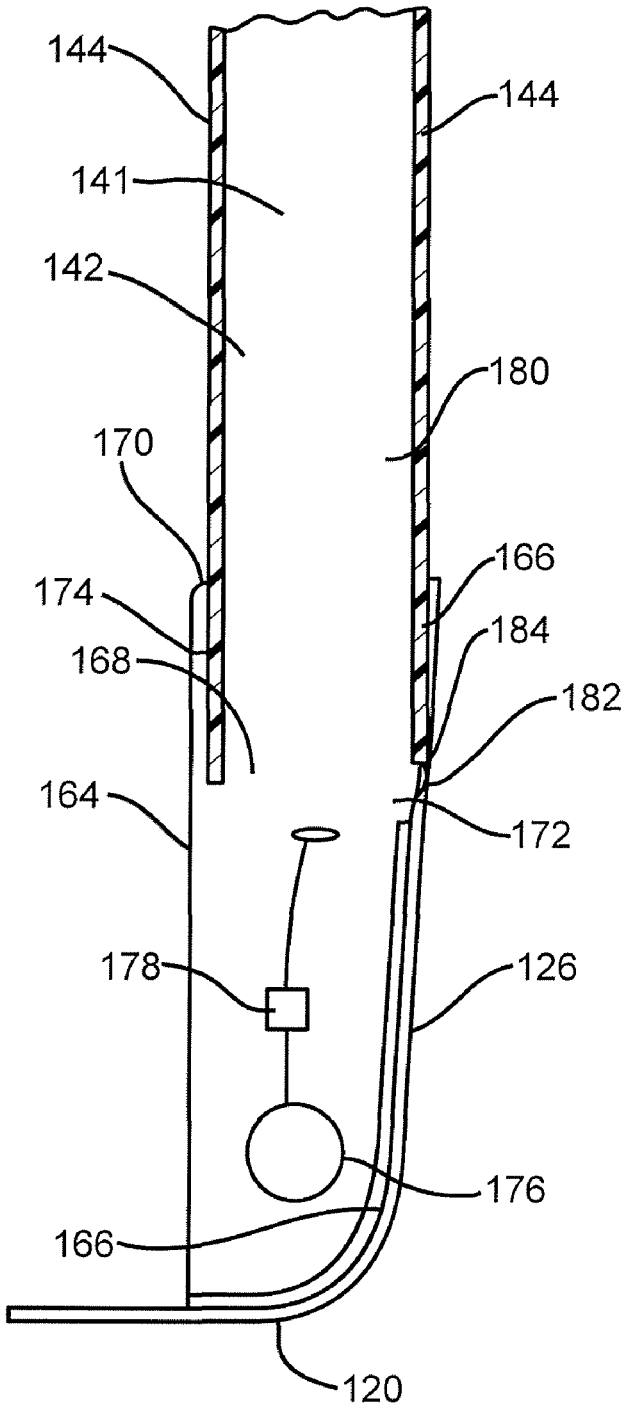
FIG. 10 shows a partial sectional, side view within rectangle 10-10 of the embodiment depicted in FIG. 9.

The enclosure member 122 may comprise inflatable gas-walls (or inflatable members) 142 which may have one or more inflatable internal cavities 141 (as shown in FIG. 10) which are inflated utilizing a pump 176 (as shown in FIG. 10) to enclose the gas-walls 142 of the compartment 110 around the basin 120. Any portion of the inflatable gas-walls 142 may have attached to and/or contain the pillow speaker system 10 of FIG. 1 in order to allow a person in the compartment 110 to listen to the speaker system 10 without disturbing others. In one embodiment, the inflatable gas-walls 142 may comprise the inflatable pillow 12 of FIG. 1, and vice-versa. In other embodiments, the enclosure member 122 may comprise other types of retractable and extendable members, such as a fabric, non-inflatable enclosure member. The inflatable walls 142 may be made of Polyurethane, but in other embodiments may be made of differing materials. The inflatable walls 142 may be colored to prevent light from entering the compartment 110 and to create a nurturing, comfortable environment. In one embodiment, the inflatable walls 142 may be between one and five inches thick in the inflated position. A surface 144 of the inflatable walls 142 may comprise a protective cover made of at least one of Kevlar and Nomex. In other embodiments, other materials may be utilized which provide puncture and/or flammability resistance, such as Basofil, and/or Spider Silk composites. The protective cover may cover only the outside surface of the inflatable walls 142, or may cover both the inside surface and the outside surface of the inflatable walls 142. The protective cover may substantially protect the inflatable walls 142 from puncture, from thermal elements, and/or may serve as a fireblock to aid in preventing the inflatable walls 142 from combusting. Moreover, the protective cover may attenuate unwanted sound (acoustic noise) from entering or leaving the compartment 110.

The inflatable walls 142 may include a left side wall 148, a back side wall 150, a right side wall 152, a top wall 154 (or ceiling), and a partition 156. In other embodiments, the inflatable walls 142 may include a bottom wall or floor surface. The inflatable walls 142 may have zippered seams (not shown) by which the walls are zippered together. In other embodiments, the inflatable walls 142 may be connected utilizing varying methods such as snap-fits, or may comprise one integral unseamed wall and/or enclosure. In still other embodiments, the inflatable walls 142 may include differing types, numbers, sizes, orientations, and/or configurations of inflatable members, such as an inflatable seat, an inflatable bed, or other inflatable devices.

The partition 156 may divides the compartment 110 into two bunk portions, enabling the compartment 110 to accommodate two people 158. In other embodiments, the compartment 10 may accommodate any number of people. The inflatable walls 142 may also comprise at least one air valve 160 for inflating the inflatable walls 142, and flaps 162 for attaching the inflatable walls 142 to the basin 120. The flaps 162 may comprise snaps, screws, or other fasteners. In some embodiments, the left side wall 148, back side wall 150, right side wall 152, top wall (or ceiling) 154, partition 156, and/or bottom wall or floor surface may be configured so that they may all be inflated by pumping gas into the single valve 160. In some embodiments, the inflatable walls 142 may be inflated to pressures between one pound per square inch and three pounds per square inch. In another embodiment, the inflatable walls 142 may be inflated to pressures less than 60 mbar. In other embodiments, some or all of the left side wall 148, back side wall 150, right side wall 152, top wall 154, partition 156, and/or bottom wall or floor surface may each comprise a separate air valve, and/or may each be separately inflated to different pressures. In still other embodiments, the enclosure member 122 may be in differing shapes, sizes, orientations, and/or configurations.

FIG. 10 shows a partial sectional, side view within rectangle 10-10 of the embodiment depicted in FIG. 9. As shown, one or more bolster members 164 may be attached to an interior surface 166 of the side-walls 126 of the one-piece basin 120. The bolster members 164 may be made of fiberglass or other materials, and may be attached to the side-walls 126 utilizing snap-fits, screws, adhesive, or other types of fastening mechanisms. In other embodiments, the bolster member 164 may be integrally molded to side-wall 126. A cavity 168 may be recessed within a top surface 170 of bolster member 164. An end 172 of one or more inflatable gas walls 142 may be disposed within the cavity 168 of the bolster member 164 in between an interior surface 174 of the cavity 168 and an interior surface 166 of the side-wall 126. In such manner, the inflatable gas walls 142 may be attached to the side-wall 126. In other embodiments, the inflatable wall 142 may be attached directly to a floor surface of the compartment 110, such as to the base member 124 or to another floor surface.

A gas pump 176 and a pressure transducer 178 may be attached to bolster member 164. In other embodiments, the pump 176 and pressure transducer 178 may be attached to other areas of the compartment 110. The pump 176 may be utilized to inflate the gas wall 142 from a deflated position to an inflated position in order to form a compartment wall 180. The transducer 178 may regulate pressure within the gas wall 142. The compartment wall 180 may comprise a combination of side-wall 126 and gas wall 142 which collectively extend the entire height 132 (shown in FIG. 9) of the compartment 110. In other embodiments, the compartment wall 180 may comprise solely gas wall 142 such as in the situation when gas wall 142 is attached directly to a floor surface of the compartment 110. When the gas wall 142 is inflated to form erect compartment wall 180, the inflation of end 172 of gas wall 142 may lock gas wall 142 in place between the bolster member 164 and side-wall 126 utilizing a gas-bulb lock. For instance, when end 172 is inflated, a portion 182 of end 172 may extend laterally past an end portion 184 of bolster member 164 locking end portion 184 against side-wall 126 thereby preventing end 172 from becoming un-attached from side-wall 126 and bolster member 164. In other embodiments, varying locking mechanisms may be utilized to lock gas wall 142 in place.

Figure 11:
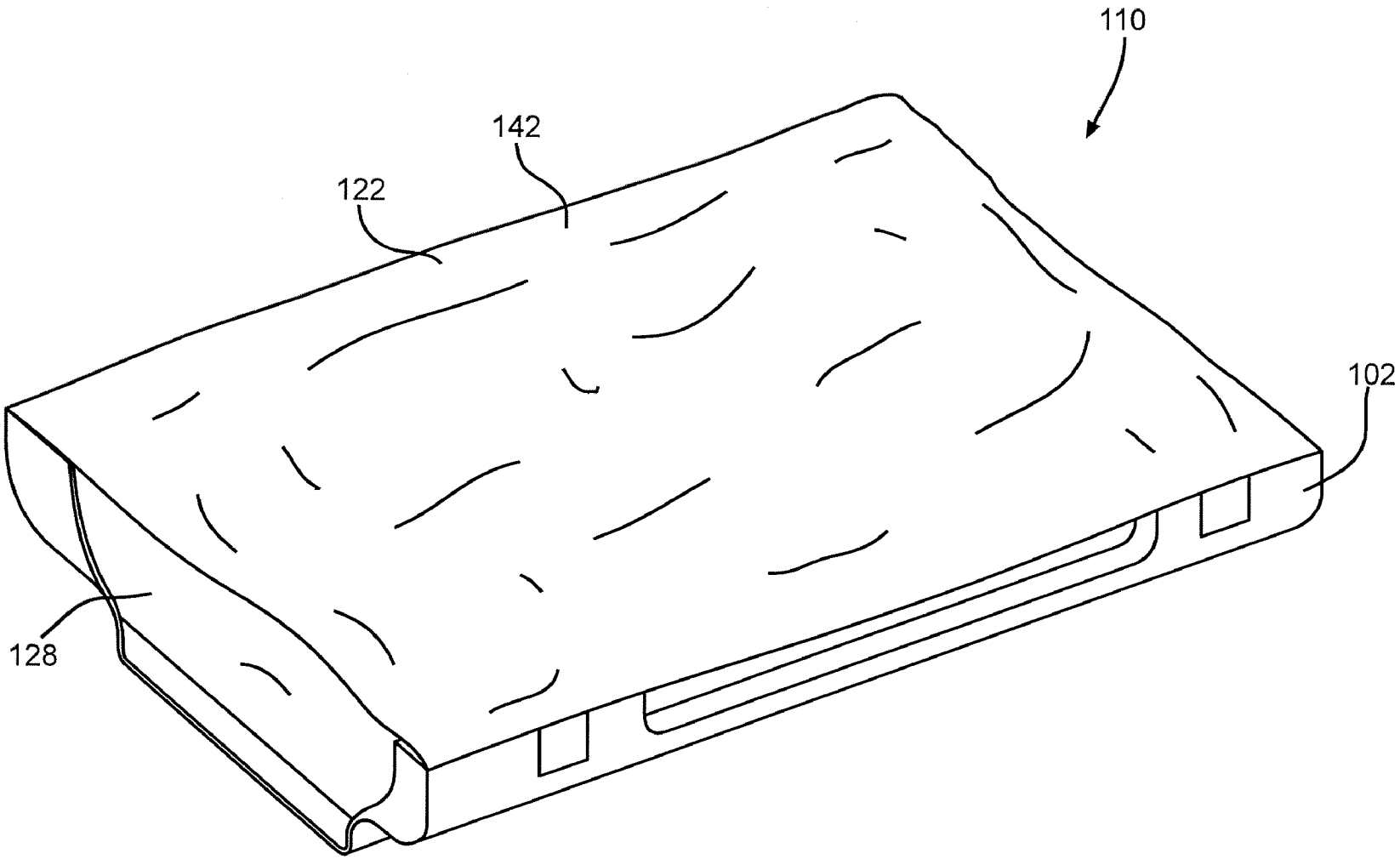
FIG. 11 shows a perspective view of the one-piece basin of FIG. 9 with the attached enclosure member in a deflated position.
Figure 12:
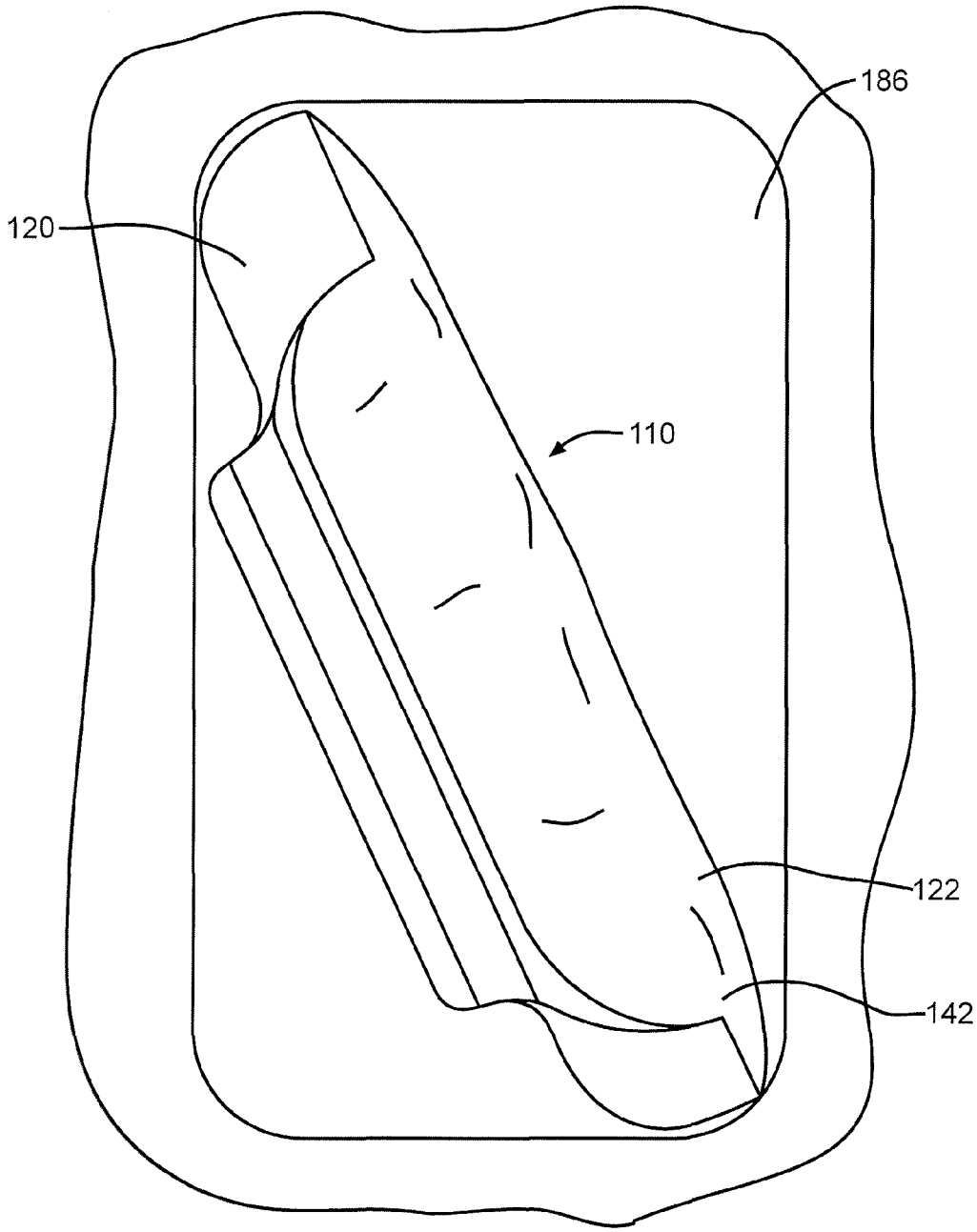
FIG. 12 shows a front view of the one-piece basin of FIG. 11 being fitted through an opening in a transportation device.

FIG. 11 shows a perspective view of the basin 120 of FIG. 9 with the attached enclosure member 122, which in this embodiment is a gas wall 142, in a deflated position. As shown, the gas wall 142 may be deflated so that it substantially retracts within cavity 128 of basin 120. When the gas wall 142 is in a deflated position, the size of the one-piece basin 120 may enable the compartment 110 to be fitted through an opening 186 (as shown in FIG. 12) in the transportation device. The opening may comprise a door or other opening in the transportation device.

FIG. 12 depicts a front view of the one-piece basin 120 of FIG. 11 being fitted through an opening 186 in a transportation device. In such manner, the compartment 110 may be brought into a transportation device with the gas wall 142 in the deflated position, the basin 120 may be installed into position within the transportation device, and the gas wall 142 may be inflated to enclose the compartment 110. In other embodiments, the enclosure member 122 may be brought into the transportation device separately from the one-piece basin 120, and installed to the one-piece basin 120 within the transportation device.

Figure 13:
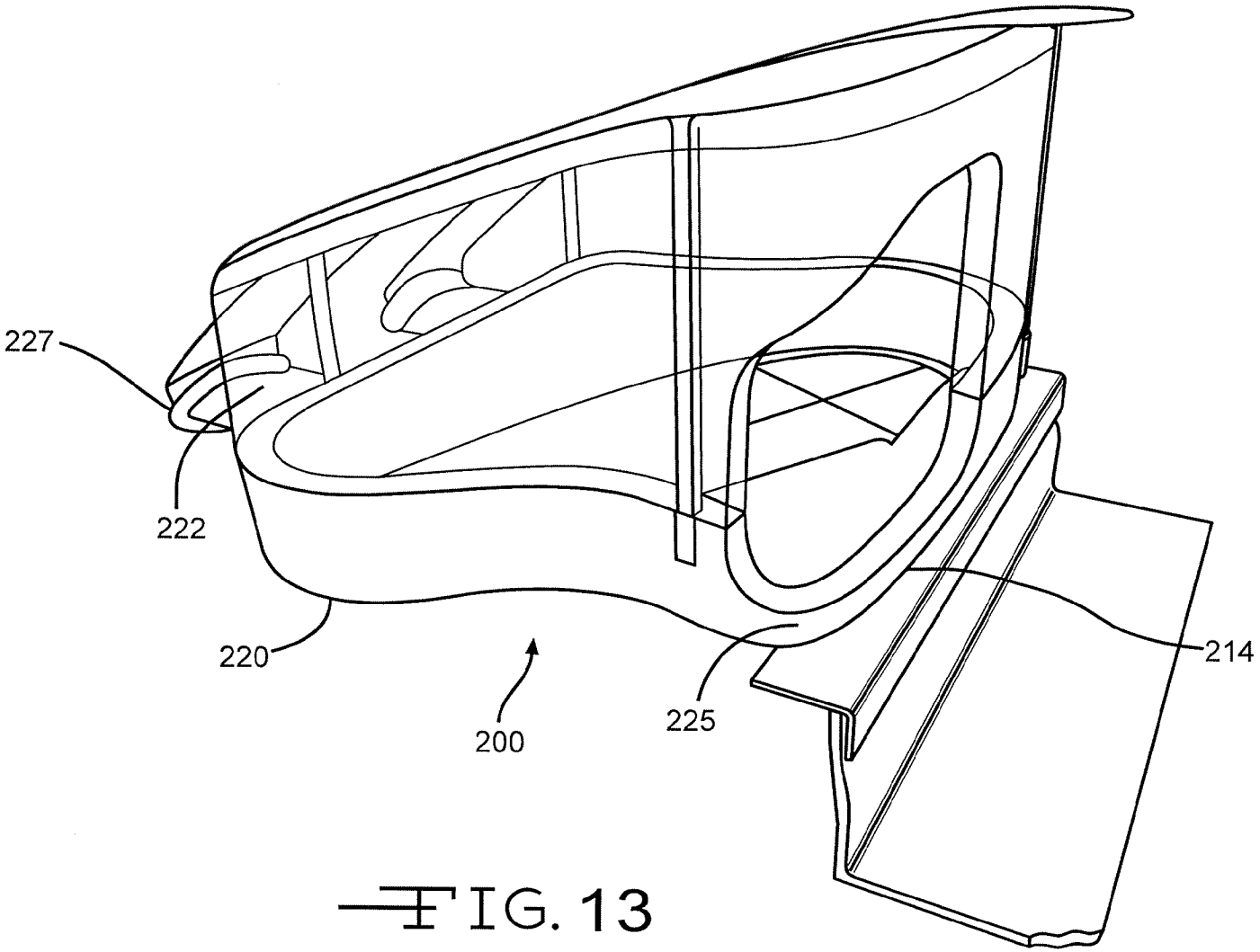
FIG. 13 shows a perspective view of another embodiment of a compartment having a curved one-piece basin and a curved, attached, retractable, and extendable enclosure member shown in an inflated, extended state.

FIG. 13 depicts a perspective view of another embodiment of a compartment 200 having a curved one-piece basin 220 and a curved, attached, retractable, and extendable enclosure member 222 shown in an inflated, extended state. A portion 225 of the basin 220 may be aligned at the top of a stairway 214 within the transportation device. One or more support arms 227 may be attached to the basin 220 in order to attach the compartment 200 to an interior of the transportation device.

Figure 14:
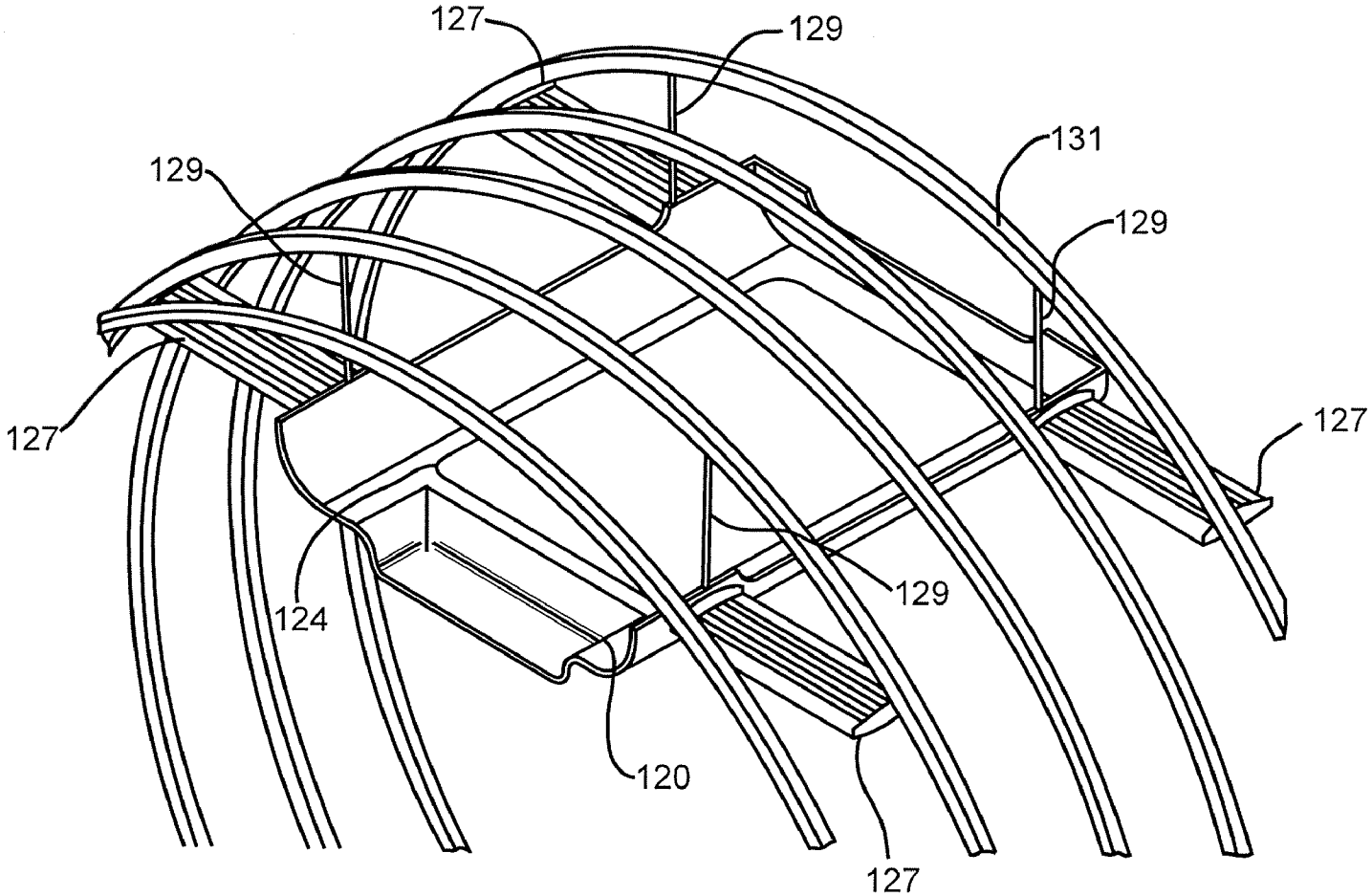
FIG. 14 shows a perspective view of the one-piece basin of FIG. 9 installed in a transportation device utilizing a plurality of multi-directional support arms and tension members.

FIG. 14 depicts a perspective view of the one-piece basin 120 of FIG. 9 installed in a transportation device utilizing a plurality of multi-directional support arms 127, in addition to a plurality of tension members 129, to attach the basin 120 to a frame 131 of the transportation device. In other embodiments, the multi-directional support arms 127 may be utilized to attach any compartment or internal structure, such as an internal aircraft structure, to at least one of a skin of the transportation device, a frame of the transportation device, or to an inter-costal member connected to the frame of the transportation device. The attached internal aircraft components may comprise one or more of a monument, stowage area, galley area, system rack, partition, stairway, rest area, stowage bins, and/or other types of internal parts. The multi-directional support arms 127 may be attached to the internal structure, skin of the transportation device, frame of the transportation device, and/or to the inter-costal member connected to the frame of the transportation device utilizing bolts, fasteners, snap-fits, or through other mechanisms.

The multi-directional support arms 127 may be installed in a substantially horizontal orientation extending between the frame 131 and the basin 120, while the tension members 129, which may be under only tension load, may be installed in a substantially vertical orientation and/or upward orientation extending between the frame and the basin 120. This configuration may substantially maximize space in order to locate one or more aircraft systems, such as an electrical system, gas ducting, ECS ducting, water system, or other type of system within the transportation device. In other embodiments, one or more aircraft systems may be run through one or more cavities within the multi-directional support arms 127 to further increase space utilization. In additional embodiments, the tension members 129 may be connected to a skin and/or a inter-costal member of the transportation device.

In other embodiments, the multi-directional support arms 127 and tension members 129 may be installed in varying numbers, locations, orientations, and configurations. The base member 124 of the basin 120 may be installed in a substantially horizontal position within the transportation device in order to act as a floor surface of the compartment 110 (as shown in FIG. 9). After the basin 120 is installed within the transportation device, the enclosure member 122 (as shown in FIG. 9) may be extended and/or inflated to a substantially vertical position to form the enclosure of the compartment 110. In other embodiments, the basin 120 and enclosure member 122 (as shown in FIG. 9) may be in other locations, orientations, and/or configurations.

Traditional tie-rod members, which are usually used to attach interior components to transportation devices, are typically only axially loaded, and are typically oriented as close to parallel with the skin and/or frame of the transportation device as possible, in order to decrease tension load on the skin and/or frame and to transfer as much shear load as possible. This may require substantial attachment hardware in order to position the tie-rod members in the required orientations, may require a large number of tie-rod members to be utilized, may require inefficient use of space, may make it difficult to attach internal structures, and may make the installation process costly.

Figure 17:
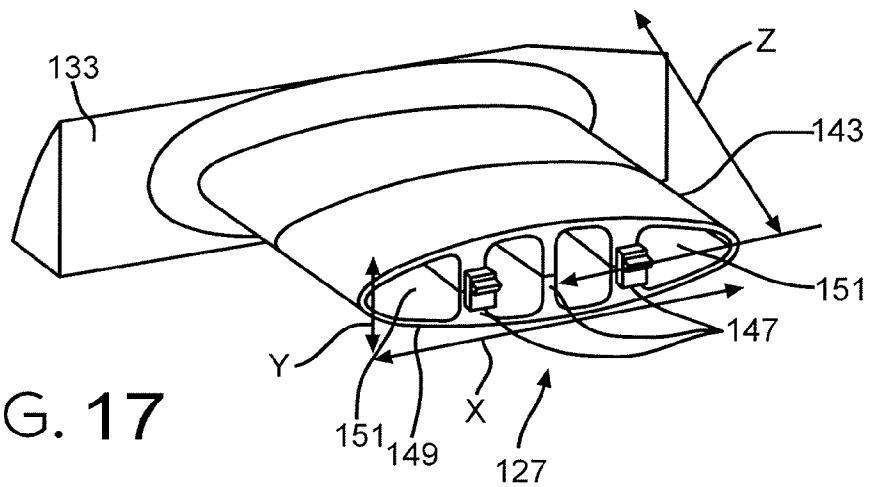
FIG. 17 shows a partially unassembled, perspective view within rectangle 17-17 of the embodiment shown in FIG. 16.

Unlike traditional tie-rod members, the multi-directional support arms 127 may be under both shear, tension, bending, and compressive loads in multiple directions, such as at least partially X, Y, and Z directions (as shown in FIG. 17), and may be adapted to be moved, rotated, and/or oriented into varying locations, configurations, and/or orientations. The use of multi-directional support arms 127, which may allow for the carrying of both shear, tension, bending, and compressive loads in at least partially X, Y, and Z directions, may allow for the transfer of shear loads directly to the skin and/or frame of the transportation device in a multitude of directions. As a result, the multi-directional capabilities of the support arms 127 may allow for the support arms 127 to be attached to the skin and/or frame in varying angles of orientation. Therefore, less attachment hardware may be required to attach the multi-directional support arms 127 to the skin and/or frame of the transportation device. This may free up space, may make it less difficult to install the support arms 127, may make the installation process less timely, and/or may make the installation process less expensive. In other embodiments, the support arms 127 may be integral to the body of the transportation device, such as a composite fuselage in an aircraft, effectively acting as an extension of the transportation device.

Figure 15:
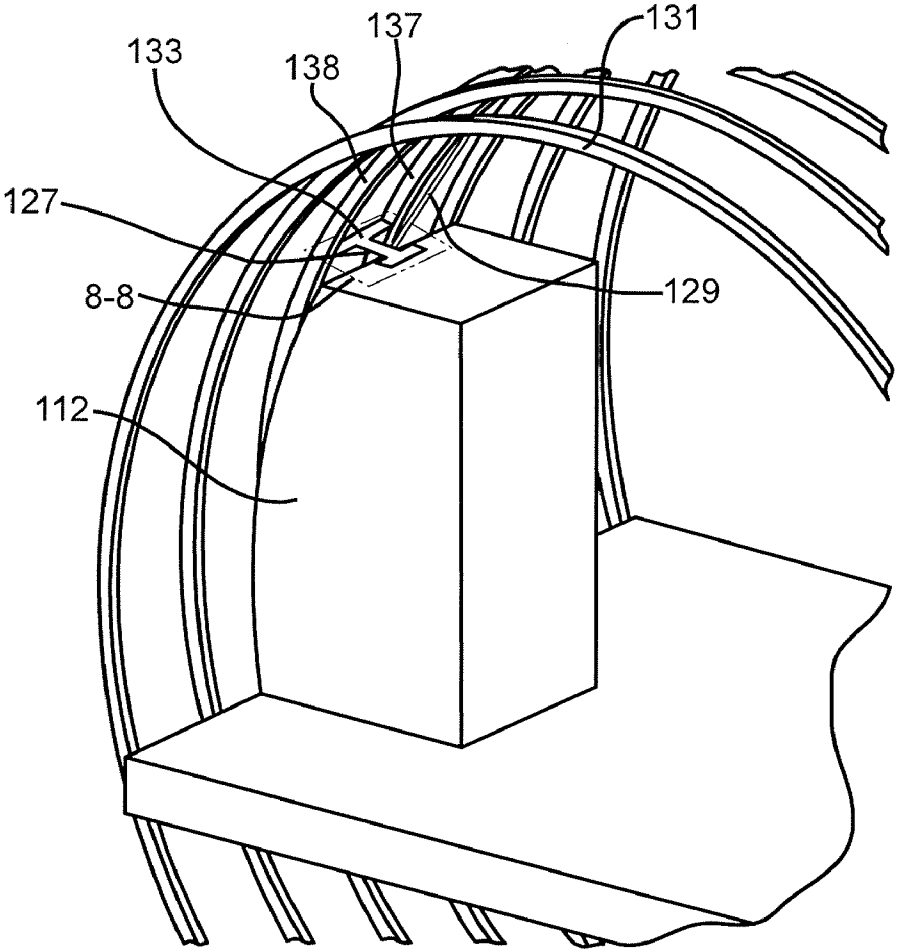
FIG. 15 shows a perspective view of one embodiment of a monument installed in a transportation device.

FIG. 15 depicts a perspective view of one embodiment of a monument 112 installed in a transportation device. A multi-directional support arm 127 is attached at one end to the monument 112 and at another end to intercostal member 133 which extends between a plurality of frame members 135 and 137 of the frame 131 of the transportation device. A tension member 129 is attached at one end to the monument 112 and at another end to frame 131. In other embodiments, one or more multi-directional support arms 127 and/or tension members 129 may be utilized to attach monument 112 directly to a skin and/or frame of the transportation device.

Figure 16:
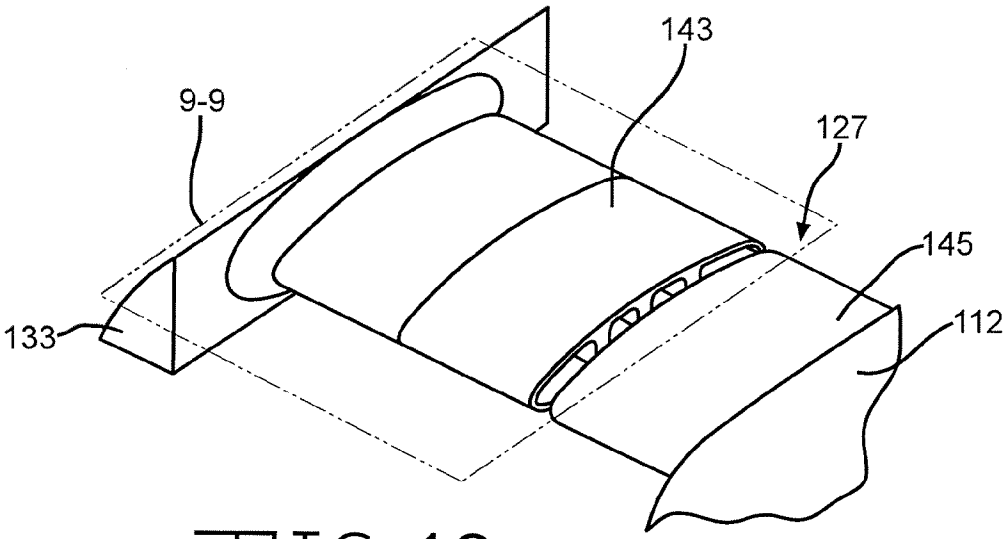
FIG. 16 shows a partially, unassembled perspective view within rectangle 16-16 of the embodiment depicted in FIG. 15.

FIG. 16 shows a partially, unassembled perspective view, within rectangle 16-16 of the embodiment depicted in FIG. 15, illustrating the attachment of two separate parts 143 and 145 of multi-directional support arm 127. As shown, part 143 of the multi-directional support arm 127 is attached to intercostal member 133, while part 145 of the multi-directional support arm 127 is attached to monument 112. The two parts 143 and 145 of the multi-directional support arm 127 may be attached together utilizing fasteners, fittings, or other attachment mechanisms. The use of two separate interconnectable parts 143 and 145 may allow for efficient installment of the monument 112 to intercostal member 133. For instance, part 143 of the multi-directional support arm may be attached to intercostal member 133. Part 145 may be attached to monument 112. Subsequently, monument 112 may be located into position in order to attach the fasteners, fittings, or other attachment devices of parts 143 and 145 together in order to attach monument 112 to intercostal member 133. In other embodiments, varying attachment mechanisms and methods may be utilized to connect varying portions of support arm 127.

FIG. 17 depicts a partially unassembled, perspective view, within rectangle 17-17 of the embodiment shown in FIG. 16, depicting intercostal member 133 and part 143 of multi-directional support arm 127 with part 145 (as shown in FIG. 16) removed. As shown, part 143 of multi-directional support arm 127 may comprise a plurality of interior linear members 147 which are substantially oriented in the Y and Z directions (with some X direction orientation), a connected exterior elliptical curved member 149 which is oriented at least partially in the X, Y, and Z directions, and interior extending cavities 151. Part 143 may be integrally molded in order to form linear members 147 and curved member 149. The multi-directional components 147 and 149 of part 143 may allow for the transfer of shear and tension loads from part 143 to intercostal member 133 in multiple directions and orientations.

One or more systems, such as an electrical system, gas ducting, ECS ducting, a water system, or other type of system, may be extended through interior cavities 151 within part 143. In such manner, the support arm 127 may be configured to substantially maximize space. Part 145 (as shown in FIG. 16) may have the same configuration as part 143. In such manner, when parts 143 and 145 are connected, shear and tension loads may be transferred in varying directions from monument 112 (as shown in FIG. 15), through the multi-directional support arm 127, to intercostal member 133, to frame 131 (as shown in FIG. 15) of the transportation device. Moreover, one or more systems may be extended through an interior of multi-directional support arm 127.

In other embodiments, multi-directional support arm 127 may be made of one or more parts in varying types, shapes, sizes, configurations, locations, and/or orientations. In additional embodiments, multi-directional support arm 127 may be configured to direct tension and shear loads in a multitude of varying directions to differing surfaces in various locations.

Figure 18:
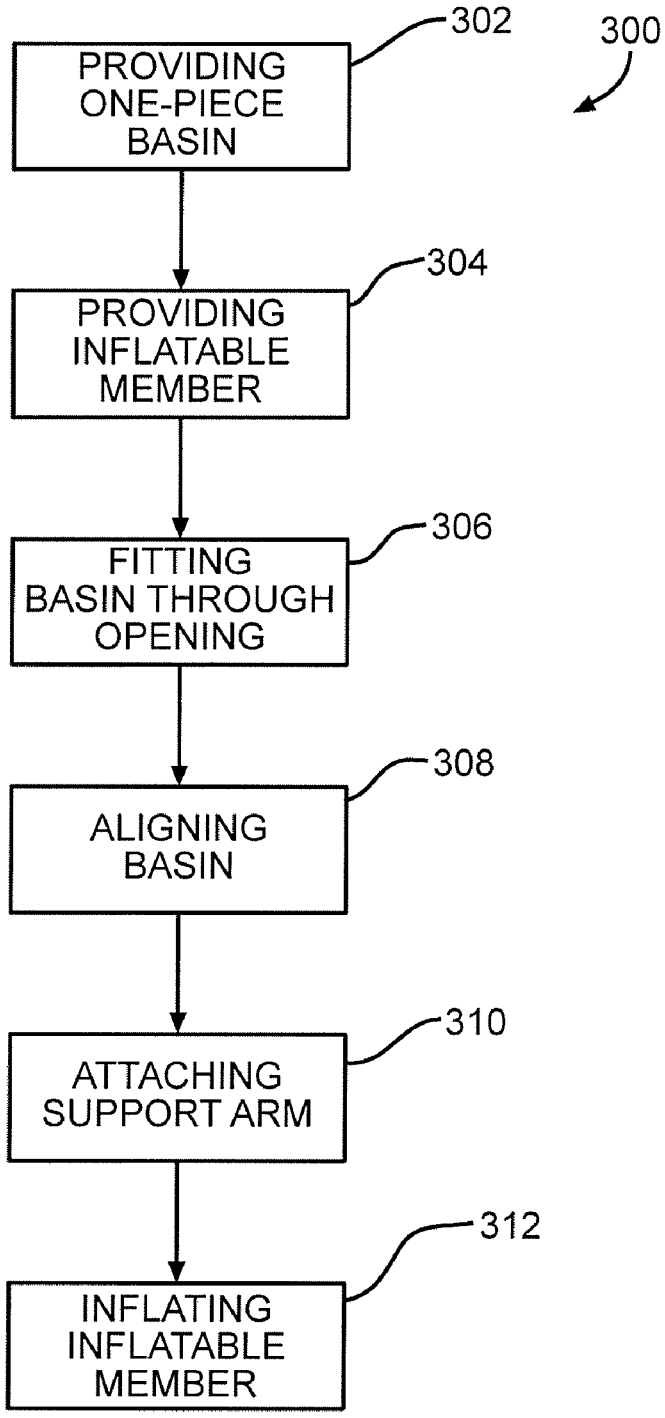
FIG. 18 shows a flowchart depicting one embodiment of a method of installing a compartment in a transportation device.

FIG. 18 shows a flowchart depicting one embodiment 300 of a method of installing a compartment in a transportation device. In one step 302, a one-piece basin having a base member may be provided. The one-piece basin may comprise any of the embodiments disclosed herein. In another step 304, an inflatable member (and/or a retractable and/or extendable enclosure member) having an internal cavity may be provided. The inflatable member may comprise any of the embodiments disclosed herein. In other embodiments, any of the basin, enclosure member (and/or inflatable wall member), and/or support arm embodiments described herein may be provided during a step of the method of installation.

In an additional step 306, the one-piece basin may be fitted through an opening in the transportation device. In such manner, the one-piece basin may be located within an interior of the transportation device. During this step, the basin may be rotated into a substantially vertical plane and/or positioned to fit the basin through the opening into the transportation device. A loading tool may be utilized during this process. For instance, the basin may be loaded on the loading tool, which may be wheeled through a door of the transportation device. In other embodiments, varying equipment and processes may be utilized to fit the basin through the opening into the transportation device. In one embodiment, the inflatable member (and/or retractable and/or extendable enclosure member) may be attached to the basin in a deflated position (or retracted position) when the basin is fitted through the opening into the transportation device.

In another embodiment, the inflatable member (and/or retractable and/or extendable enclosure member) may be attached to the basin in a deflated or inflated position (retracted or extended position) after the basin has been fitted through the opening into the transportation device. The inflatable member may be aligned in a non-parallel direction with respect to a side-wall surface of the basin. In other embodiments, the inflatable member may be aligned in a non-parallel direction to a floor surface of the compartment.

In still another step 308, the one-piece basin may be aligned so that the base member forms a floor surface of the compartment. After alignment, the basin may be in a substantially horizontal plane, and the side-wall of the basin may not extend a full height of the compartment. This step may comprise placing the loading tool and the one-piece basin in the proper position to install the basin to form the compartment. A winch, safety strap, and/or the loading tool may be utilized to raise the basin into the correct position in the air. In other embodiments, varying apparatus and methods may be utilized to align the basin into the proper position to act as a floor surface of the compartment.

In yet another step 310, one or more support arms may be attached between the one-piece basin and one or more portions of the transportation device. The support arms may be put under shear and tension loads in multiple directions, such as in at least partially X, Y, and Z directions. The support arms may have been attached to the basin and/or transportation device prior to the basin being fitted into the airplane, and may be rotatable from a non-installed position to an installed position. In another embodiment, the support arms may be attached to the basin and/or transportation device after the basin is fitted into the airplane.

The support arms may comprise any of the embodiments herein disclosed, while the portions of the transportation device may comprise a skin of the transportation device, a frame of the transportation device, and/or an intercostal member attached to the frame of the transportation device. The support arms may be attached utilizing any of the attachment methods described herein. In one embodiment, each support arm may comprise one part and may be attached to the basin and to the portions of the transportation device utilizing fittings, bolts, fasteners, and/or other mechanisms. These devices may be automatic and may be activated remotely. In other embodiments, these devices may be activated manually.

In another embodiment, each support arm may comprise multiple parts which are attached at different times respectively to one of the basin and/or portion of the transportation device. The support arm part attached to the basin may then be attached to the support arm part attached to the portion of the transportation device in order to form one complete support arm which attaches the basin to the transportation device. This may be achieved utilizing fittings, bolts, fasteners, and/or other mechanisms, which may be activated manually or automatically. A primary load of the compartment may be placed on the basin. The basin may be attached to a monument, walkway, stairway, and/or to another type of apparatus. In other embodiments, rather than being attached to a basin, the support arms may be attached to one or more internal structures with the transportation device such as a monument, a stowage area, a system rack, a partition, a stairway, a rest area, or to another type of internal structure. In additional embodiments, the support arms may be oriented to substantially maximize space for systems within the transportation device.

In an additional step 312, the inflatable member may be inflated to form a wall of the compartment. The inflatable member may be inflated utilizing air, an inert gas such as Argon, or other types of gas. A pump or other apparatus may be utilized to pump gas into a cavity of the inflatable member in order to inflate the wall. In such manner, an enclosure around the basin may be formed in order to complete the compartment. The inflatable member may provide a comfortable, nurturing environment for the compartment's occupants. In other embodiments, the inflatable member may be used as a mechanism to transport and recirculate air for the compartment's occupants. The wall of the compartment may comprise a combination of the basin side-walls and the inflatable member. Any portion of the compartment may contain a pillow speaker system in order to allow a person in the compartment to listen to the speaker system without disturbing others. In other embodiments, the wall of the compartment may comprise solely the inflatable member. The inflated enclosure may include side-wall surfaces, ceiling surfaces, partition surfaces, floor surfaces, seat surfaces, bed surfaces, and/or other surfaces. One or more zippered seams may be zipped together in order to attach multiple parts of the inflatable member together. In other embodiments, the inflatable member may be one part.

In other embodiments, power lines and various systems may be connected to the compartment. These systems may comprise any systems of the transportation device, such as electrical, venting, ducting, water, and other types of systems.

In additional method embodiments, the basin of the compartment may be installed separately, the inflatable wall of the compartment may be installed separately, the support arms may be installed separately, and/or any combination of the basin, inflatable wall, and/or support arms may be installed. Any of the herein disclosed basin, inflatable wall (and/or enclosure member), and/or support arm embodiments may be utilized in any of these method embodiments.

It should be understood, of course, that the foregoing relates to exemplary embodiments of the invention and that modifications may be made without departing from the spirit and scope of the invention as set forth in the following claims.

We claim:

1. A pillow speaker system comprising:

an inflatable pillow comprising a gas cavity closed off to air outside of said gas cavity; and at least one speaker disposed between two cells, divided by a partition, of the gas cavity, said at least one speaker extending over part of each of the two cells in order to emit sound into each of the two cells;

wherein one of: (1) a support member is suspended from said gas cavity forming a pocket, outside of said gas cavity, between said support member and said gas cavity with said at least one speaker disposed within said pocket; or (2) said at least one speaker is attached to an interior surface of said gas cavity.

2. The pillow speaker system of claim 1 wherein said gas cavity contains air at a pressure of substantially in the range of 0.25 pounds per square inch to 1.5 pounds per square inch.

3. The pillow speaker system of claim 1 wherein said support member is suspended from said gas cavity forming the pocket, outside of said gas cavity, between said support member and said gas cavity with said at least one speaker disposed within said pocket.

4. The pillow speaker system of claim 3 wherein said support member is attached to said gas cavity using glue or tape.

5. The pillow speaker system of claim 3 wherein one side of the pocket is open to allow said at least one speaker to be moved out of or into said pocket.

6. The pillow speaker system of claim 1 wherein said gas cavity contains at least one slotted partition within said gas cavity, wherein slots of the slotted partition extend along the slotted partition for most of a distance between opposing interior surfaces of said gas cavity to spread the sound emitted from said at least one speaker within said gas cavity.

7. The pillow speaker system of claim 1 wherein said at least one speaker comprises a diaphragm comprising an embedded coil and a magnet.

8. The pillow speaker system of claim 1 wherein said gas cavity is made of a material which substantially absorbs the sound emitted from said at least one speaker and substantially blocks the sound from radiating outward from within the gas cavity.

9. The pillow speaker system of claim 1 wherein said at least one speaker has a flat shape.

10. The pillow speaker system of claim 1 wherein said at least one speaker is attached to the interior surface of said gas cavity.

11. The pillow speaker system of claim 10 wherein said at least one speaker is completely enclosed within said gas cavity.

12. The pillow speaker system of claim 1 wherein said pillow speaker system is located within an opening in a second pillow.

13. The pillow speaker system of claim 12 wherein said second pillow is made of foam or fabric.

14. The pillow speaker system of claim 12 wherein said opening extends from an outer surface of said second pillow into an interior of said second pillow.

15. The pillow speaker system of claim 1 wherein said pillow speaker system is attached to an inflated wall of a compartment, wherein the inflated wall of the compartment extends substantially vertically.

16. A pillow speaker system comprising:

an inflatable pillow comprising a gas cavity closed off to air outside of said gas cavity;

a second pillow comprising an opening; and at least one speaker, wherein sound emitted from said at least one speaker is substantially contained within said gas cavity;

wherein one of: (1) a support member is suspended from said gas cavity forming a pocket, outside of said gas cavity, between said support member and said gas cavity with said at least one speaker disposed within said pocket; or (2) said at least one speaker is attached to an interior surface of said gas cavity;

wherein said inflatable pillow is located within the opening of the second pillow.

17. The pillow speaker system of claim 16 wherein support member is suspended from said gas cavity forming the pocket, outside of said gas cavity, between said support member and said gas cavity with said at least one speaker disposed within said pocket.

18. The pillow speaker system of claim 16 wherein said at least one speaker is attached to the interior surface of said gas cavity.

19. The pillow speaker system of claim 16 wherein said second pillow is made of foam or fabric.

20. The pillow speaker system of claim 16 wherein said opening extends from an outer surface of said second pillow into an interior of said second pillow.

* * * * *